US011295946B2

(12) United States Patent
Yoon et al.

(10) Patent No.: US 11,295,946 B2
(45) Date of Patent: Apr. 5, 2022

(54) TRIPLE TUBE TYPE EXCIMER LAMP

(71) Applicant: UNILAM CO., LTD., Ulsan (KR)

(72) Inventors: Joo Young Yoon, Busan (KR); Young Duk Ha, Busan (KR); Eun Sik Kim, Busan (KR); Hong Chae Jung, Gyeongsangnam-do (KR); So Ree Kim, Ulsan (KR)

(73) Assignee: UNILAM CO., LTD., Ulsan (KR)

( * ) Notice: Subject to any disclaimer, the term of this patent is extended or adjusted under 35 U.S.C. 154(b) by 0 days.

(21) Appl. No.: 17/375,680

(22) Filed: Jul. 14, 2021

(65) Prior Publication Data

US 2022/0020581 A1 Jan. 20, 2022

(30) Foreign Application Priority Data

Jul. 14, 2020 (KR) ..... 10-2020-0086847

(51) Int. Cl.
*H01J 61/54* (2006.01)
*H01J 65/00* (2006.01)

(52) U.S. Cl.
CPC ..... *H01J 61/547* (2013.01); *H01J 65/00* (2013.01)

(58) Field of Classification Search
CPC ..... H01J 65/00; H01J 61/54–548
See application file for complete search history.

(56) References Cited

U.S. PATENT DOCUMENTS 3,610,983 A * 10/1971 Grabner ..... H01J 61/547 313/25
2004/0119412 A1* 6/2004 Katou ..... H01J 61/86 313/607

FOREIGN PATENT DOCUMENTS

DE 102015101804 A1 * 8/2016 ..... H01J 61/547
KR 2010-0061323 A 6/2010
WO WO-0173817 A1 * 10/2001 ..... H01J 61/547
WO WO-2017159342 A1 * 9/2017 ..... A61N 5/06

* cited by examiner

*Primary Examiner* — Mariceli Santiago
(74) *Attorney, Agent, or Firm* — The PL Law Group, PLLC

(57) ABSTRACT

A triple tube type excimer lamp according to an embodiment of the present invention includes a discharge unit which includes an outer tube having an external electrode on an outer circumferential surface thereof, an inner tube having the same axis as the outer tube, inserted into the outer tube, and having an internal electrode on an inner surface thereof, and one pair of assembly tubes respectively disposed on both sides of the inner tube, and configured to generate light by discharge, a cover tube having a shape surrounding an outer side of the outer tube; and one pair of bases respectively coupled with the one pair of assembly tubes and respectively sealed with both ends of the cover tube.

5 Claims, 3 Drawing Sheets

TRIPLE TUBE TYPE EXCIMER LAMP

CROSS-REFERENCE TO RELATED APPLICATIONS

This application claims the benefit under 35 USC § 119(a) of Korean Patent Application No. 10-2020-0086847, filed on Jul. 14, 2020, in the Korean Intellectual Property Office, the entire disclosure of which is incorporated herein by reference for all purposes.

BACKGROUND

1. Technical Field

Embodiments of the present invention relates to a triple tube type excimer lamp.

2. Background Art

An excimer lamp is one kind of lamp using dielectric barrier discharge. Here, the dielectric barrier discharge represents discharge generated between two electrodes separated by an insulation dielectric material.

Among the excimer lamps, a typical double tube type excimer lamp has a double tube structure including an outer tube and an inner tube. The double tube type excimer lamp represents a lamp using dielectric barrier discharge generated when a high voltage is applied to electrodes respectively installed on surfaces of the outer tube and the inner tube.

FIG. 1A is a view illustrating an outer shape of the typical double tube type excimer lamp, and FIG. 1B is a cross-sectional view illustrating a double tube lamp of the typical double tube type excimer lamp.

A typical double tube type excimer lamp 1 includes a lamp 2 and a base 3 coupled to each of both sides of the lamp 2. Also, power is supplied to the lamp 2 through a wire 4. The lamp 2 has a double tube structure having a cylindrical shape in which an outer tube 5 and an inner tube 7 have the same axis, an external electrode 6 is formed on an outer circumferential surface of the outer tube 5, and an internal electrode 8 is formed on an inner circumferential surface of the inner tube 7. Also, a discharge space is formed between the outer tube 5 and the inner tube 7, and a discharge gas for forming excimer molecules is filled in the discharge space by the dielectric barrier discharge. Both ends of the lamp 2 having the double tube structure are sealed, and the sealed portions are coupled with the base 3 to fix the lamp to a mechanical device.

As power having a high frequency and a high voltage is applied to the external electrode 6 and the internal electrode 8, the excimer discharge is generated, and light is emitted by the excimer discharge. The emitted light is used for various purposes such as light cleaning, air purification, surface modification, or skin treatment according to a wavelength of the emitted light.

However, when the power having the high frequency and the high voltage is applied to the external electrode 6 and the internal electrode 8, oxygen is decomposed from surfaces of the both electrodes to generate ozone (refer to FIG. 1B). Particularly, when the excimer lamp 1 is used indoors, the generated ozone is accumulated to harm a human body. Thus, the excimer lamp 1 may not be used alone, and an ozone purification device for removing or decomposing the ozone may be essentially used. The ozone purification device includes an ozone filter or an ozone decomposition catalyst.

That is, when the typical double tube type excimer lamp is used, ozone is generated to harm a human body, and thus the separate ozone purification device for removing or decomposing the ozone is required. Thus, the entire device has a complicated and large structure. Also, costs for mounting the separate ozone purification device increase.

SUMMARY

Embodiments of the present invention provide a triple tube type excimer lamp that does not generate ozone to the outside during excimer discharge.

Embodiments of the present invention also provide a triple tube type excimer lamp that does not require an ozone purification device.

According to an embodiment of the present invention, a triple tube type excimer lamp includes: a discharge unit including an outer tube having an external electrode on an outer circumferential surface thereof, an inner tube having the same axis as the outer tube, inserted into the outer tube, and having an internal electrode on an inner surface thereof, and one pair of assembly tubes respectively disposed on both sides of the inner tube, and configured to generate light by discharge; a cover tube having a shape surrounding an outer side of the outer tube; and one pair of bases respectively coupled with the one pair of assembly tubes and respectively sealed with both ends of the cover tube.

An inert gas may be accommodated in a space between the outer tube and the inner tube, and discharge light may be emitted form the inert gas.

The internal electrode may be made by using a metallic material including at least one of silver (Ag), aluminum (Al), magnesium (Mg), gold (Au), copper (Cu), zinc (Zn), nickel (Ni), platinum (Pt), stainless steel, iron (Fe), indium (In), and tin (Sn).

The cover tube may be made of quartz.

The inside of the triple tube type excimer lamp may be sealed by the cover tube and the one pair of bases.

According to the embodiments of the present invention, the triple tube type excimer lamp may be formed by adding the cover tube to the outer side of the discharge unit of the double tube type excimer lamp and sealing the cover tube with the base to prevent the ozone generated during the excimer discharge process from being leaked to the outside. Thus, the pollution caused by the ozone may be prevented by the triple tube type excimer lamp.

Also, according to the embodiments of the present invention, since the ozone is not leaked to the outside of the lamp, the ozone purification device for removing or decomposing the ozone may not be necessarily provided with the excimer lamp, and thus the device may have a simple configuration to save costs.

DETAILED DESCRIPTION

Hereinafter, exemplary embodiments of the present invention will be described with reference to the accompanying drawings. Hereinafter, in the following description, specific details such as a method, a device, and/or a system are described to provide more general understandings of the present invention. However, this is merely an example, and the embodiments of the present invention are not limited thereto.

Moreover, detailed descriptions related to well-known functions or configurations will be ruled out in order not to unnecessarily obscure subject matters of the present invention. Also, terms used in this specification are terms defined in consideration of functions according to embodiments, and thus the terms may be changed according to the intension or usage of a user or operator. Therefore, the terms should be defined on the basis of the overall contents of this specification. It will be understood that although the terms are used herein to describe various embodiments of the present inventions and should the embodiments not be limited by these terms. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Figure 1A:
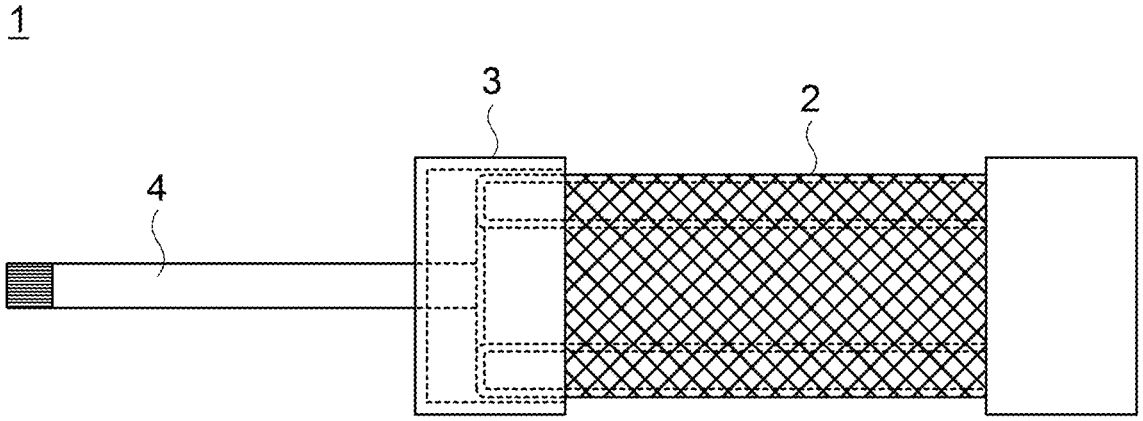
FIG. 1A is a view illustrating an outer shape of the typical double tube type excimer lamp.
Figure 1B:
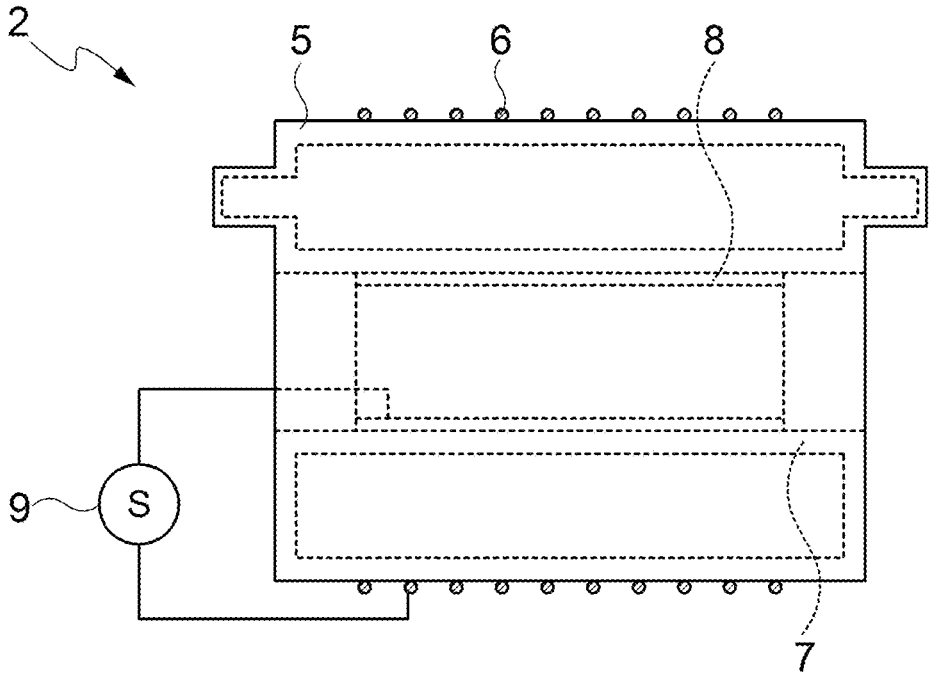
FIG. 1B is a cross-sectional view illustrating a double tube lamp of the typical double tube type excimer lamp.
Figure 2:
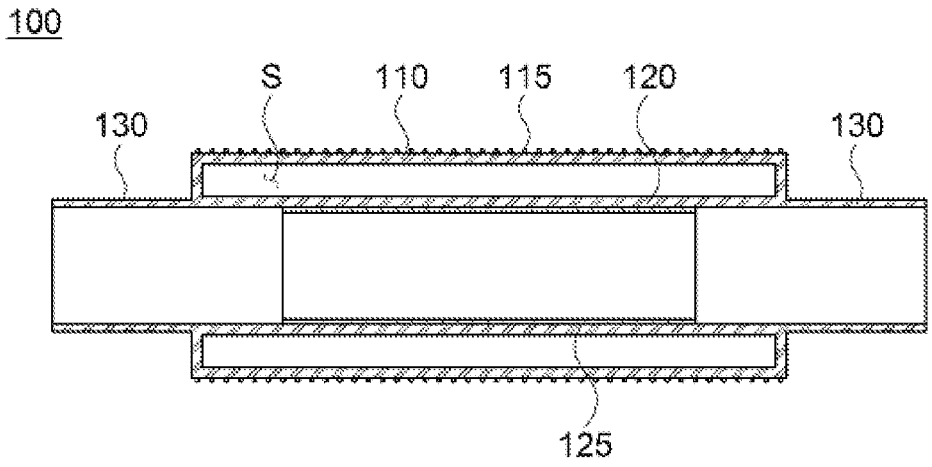
FIG. 2 is a cross-sectional view illustrating a discharge unit used in a triple tube type excimer lamp according to an embodiment of the present invention.

FIG. 2 is a cross-sectional view illustrating a discharge unit used in a triple tube type excimer lamp according to an embodiment of the present invention.

Referring to FIG. 2, a discharge unit 100 according to an embodiment of the present invention may include an outer tube 110 and an inner tube 120 having the same axis as the outer tube 110 and inserted into the outer tube, and one pair of assembly tubes 130 may be formed on both sides of the inner tube 120, respectively. The one pair of assembly tubes 130 may have tube shapes extending in parallel to each other from the both sides of the inner tube 120.

An external electrode 115 may be formed on an outer circumferential surface of the outer tube 110, and an internal electrode 125 may be formed on an inner surface of the inner tube 120. An inert gas may be accommodated in an inner space S formed by the outer tube 110 and the inner tube 120.

Here, the external electrode 115 may have a coil shape rotating along an outer circumferential surface of the outer tube 110 to surround the outer tube 110 or a mesh shape covering the outer circumferential surface of the outer tube 110.

Although the inert gas may be a xenon (Xe) gas, the embodiment of the present invention is not limited thereto. For example, the inert gas may be one of arbitrary excimer (KrCl, KrBr, XeI, XeCl, Xe, etc.).

The internal electrode 125 may be a tube having a cylindrical shape made of metal having a predetermined reflectance.

Specifically, since a high voltage is applied to the internal electrode 140, the internal electrode 140 may be made of a metallic material including at least one of silver (Ag), aluminum (Al), magnesium (Mg), gold (Au), copper (Cu), zinc (Zn), nickel (Ni), platinum (Pt), stainless steel, iron (Fe), indium (In), and tin (Sn).

When the power having the high frequency and the high voltage is applied between the external electrode 115 and the internal electrode 125, as the excimer discharge is generated, light may be emitted.

Figure 3:
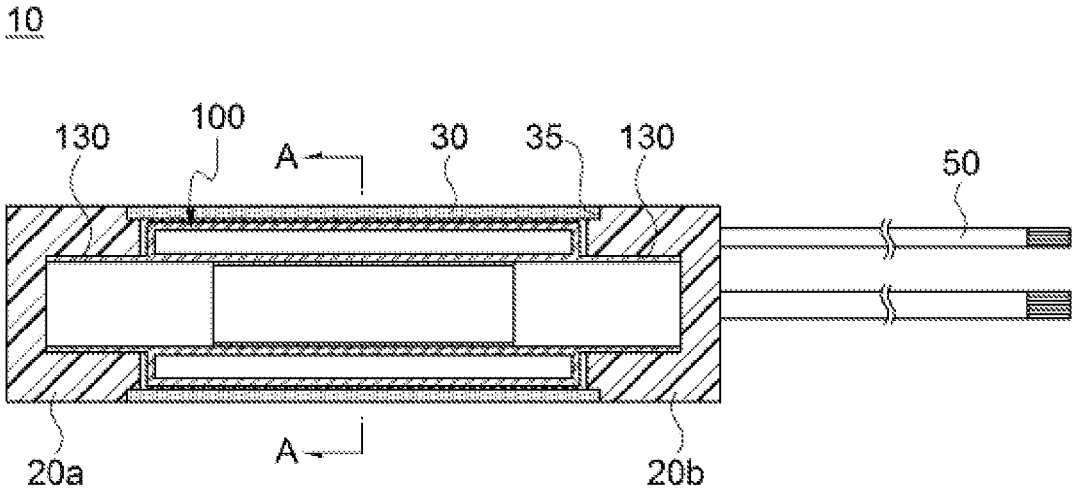
FIG. 3 is a view illustrating a triple tube type excimer lamp according to an embodiment of the present invention.
Figure 4:
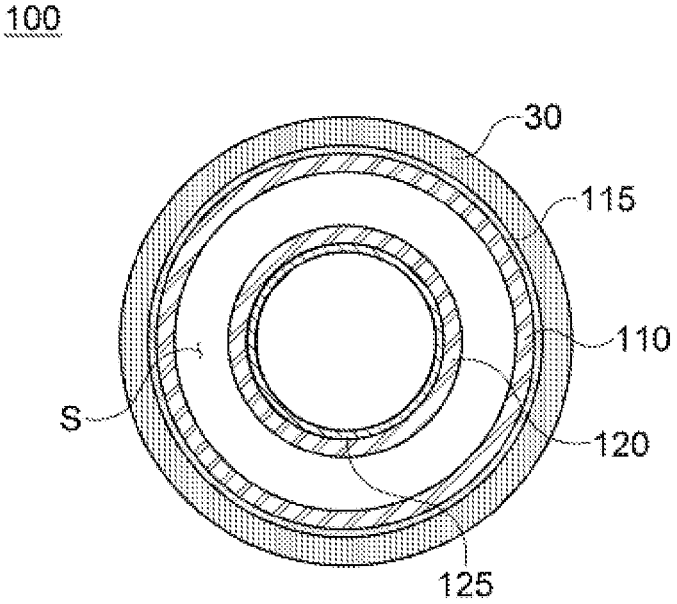
FIG. 4 is a cross-sectional view taken along the line A-A of FIG. 3.

FIG. 3 is a view illustrating a triple tube type excimer lamp according to an embodiment of the present invention, and FIG. 4 is a cross-sectional view taken along line A-A of FIG. 3.

Referring to FIGS. 3 and 4, a triple tube type excimer lamp 10 according to an embodiment of the present invention has a structure in which the discharge unit 100 in FIG. 2 is sealed by one pair of bases 20*a* and 20*b* and a cover tube 30.

That is, the cover tube 30 may have a tube shape surrounding an outer side of an outer tube 110. The cover tube 30 may be made of a material through which light generated from a discharge unit 100 is transmitted. Particularly, when ultraviolet light (UV) is generated from the discharge unit 100, the cover tube 30 may be formed so that the UV is transmitted therethrough.

Also, the one pair of bases 20*a* and 20*b* may be respectively coupled with one pair of assembly tubes 130 included to both sides of the discharge unit 100. That is, the bases 20*a* and 20*b* may have a space to which the assembly tube 130 is inserted, and as the assembly tube 130 is inserted to the space of the bases 20*a* and 20*b*, the bases 20*a* and 20*b* and the discharge unit 100 may be firmly coupled to each other.

The one pair of bases 20*a* and 20*b* may contact both ends of the cover tube 30, respectively, and contact portions 35 of the one pair of bases 20*a* and 20*b* and the cover tube 30 may be sealed. Through this, as the inside of the triple tube type excimer lamp 10 is sealed from the outside by the cover tube 30 and the one pair of bases 20*a* and 20*b*, air may not enter the inside of the triple tube type excimer lamp 10. Thus, the ozone generated from the excimer lamp may be prevented from being leaked to the outside, and the separate ozone purification device for decomposing and removing the ozone may not be required.

Also, a wire 50 may be connected to external electrode 115 and the internal electrode 125 in order to apply the power having the high frequency and the high voltage to the external electrode 115 and the internal electrode 125.

As illustrated in FIG. 4, the excimer lamp having the triple tube type of the cover tube 30, the outer tube 110, and the inner tube 120 may be provided.

A concentration of ozone generated from the lamp is measured by applying a power of 40 W to the typical double tube type excimer lamp and the triple tube type excimer lamp 10 according to an embodiment of the present invention. Measured results are shown in table 1 below.

TABLE 1

| | Ozone concentration (ppm) | |
|---|---|---|
| Number of times | Typical double tube type excimer lamp | Triple tube type excimer lamp |
| 1 | 0.095 | 0.000 |
| 2 | 0.035 | 0.000 |
| 3 | 0.065 | 0.000 |
| Average | 0.063 | 0.000 |

As shown in the above table 1, while the typical double tube type excimer lamp requires the separate ozone purification device for removing ozone because the ozone is generated to the outside, the triple tube type excimer lamp 10 according to an embodiment of the present invention does not require the separate ozone purification device for removing ozone to be mounted thereto because the ozone is not measured.

Although the embodiments of the present invention have been described, it is understood that the present invention should not be limited to these embodiments but various changes and modifications can be made by one ordinary skilled in the art within the spirit and scope of the present invention as hereinafter claimed. Therefore, the scope of the present invention is defined not by the detailed description of the invention but by the appended claims, and all differences within the scope will be construed as being included in the present invention.

What is claimed is:

1. A triple tube type excimer lamp comprising:

a discharge unit comprising an outer tube having an external electrode on an outer circumferential surface thereof, an inner tube having the same axis as the outer tube, inserted into the outer tube, and having an internal electrode on an inner surface thereof, and one pair of assembly tubes respectively disposed on both sides of the inner tube, and configured to generate light by discharge;

a cover tube having a shape surrounding an outer side of the outer tube; and one pair of bases respectively coupled with the one pair of assembly tubes and respectively sealed with both ends of the cover tube.

2. The triple tube type excimer lamp of claim 1, wherein an inert gas is accommodated in a space between the outer tube and the inner tube; and discharged light is emitted form the inert gas.

3. The triple tube type excimer lamp of claim 1, wherein the internal electrode is made by using a metallic material comprising at least one of silver (Ag), aluminum (Al), magnesium (Mg), gold (Au), copper (Cu), zinc (Zn), nickel (Ni), platinum (Pt), stainless steel, iron (Fe), indium (In), and tin (Sn).

4. The triple tube type excimer lamp of claim 1, wherein the cover tube is made of quartz.

5. The triple tube type excimer lamp of claim 1, wherein the inside of the triple tube type excimer lamp is sealed by the cover tube and the one pair of bases.

* * * * *